US006971283B2

(12) United States Patent
Belik

(10) Patent No.: US 6,971,283 B2
(45) Date of Patent: Dec. 6, 2005

(54) JAW INSERT FOR GRIPPING A CYLINDRICAL MEMBER AND METHOD OF MANUFACTURE

(75) Inventor: Jaroslav Belik, Pearland, TX (US)

(73) Assignee: National-Oilwell, L.P., Houston, TX (US)

( * ) Notice: Subject to any disclaimer, the term of this patent is extended or adjusted under 35 U.S.C. 154(b) by 32 days.

(21) Appl. No.: 10/661,707

(22) Filed: Sep. 12, 2003

(65) Prior Publication Data

US 2004/0051259 A1 Mar. 18, 2004

Related U.S. Application Data

(60) Provisional application No. 60/410,215, filed on Sep. 12, 2002.

(51) Int. Cl.[7] ..... B25B 13/50
(52) U.S. Cl. ..... 81/57.33; 81/57.15; 81/186
(58) Field of Search ..... 81/57.15, 57.33, 81/186

(56) References Cited

U.S. PATENT DOCUMENTS

| | | | | |
|---|---|---|---|---|
| 2,374,192 A | * | 4/1945 | Godfrey | 81/186 |
| 2,609,720 A | * | 9/1952 | Barnard | 81/186 |
| 2,720,128 A | * | 10/1955 | Woolley | 81/186 |
| 2,962,919 A | | 12/1960 | Grundmann et al. | |
| 3,124,023 A | * | 3/1964 | Marquis et al. | 81/186 |
| 3,205,736 A | * | 9/1965 | Crickmer | 81/186 |
| 3,247,742 A | | 4/1966 | Woodbury | |
| 3,272,038 A | | 9/1966 | Burstall | |
| 3,365,762 A | * | 1/1968 | Spiri | 81/186 |
| 4,475,607 A | | 10/1984 | Haney | |
| 4,648,292 A | | 3/1987 | Haynes et al. | |
| 4,649,777 A | | 3/1987 | Buck | |
| 4,869,137 A | | 9/1989 | Slator | |
| 5,193,397 A | | 3/1993 | Hugelier et al. | |
| 5,451,084 A | | 9/1995 | Jansch | |
| 5,868,045 A | | 2/1999 | Hauk | |
| 5,971,086 A | | 10/1999 | Bee et al. | |
| 6,070,500 A | * | 6/2000 | Dlask et al. | 81/57.33 |
| 6,079,509 A | | 6/2000 | Bee et al. | |
| 6,264,395 B1 | | 7/2001 | Allamon et al. | |
| 6,302,410 B1 | | 10/2001 | Wentworth et al. | |
| 2002/0108748 A1 | | 8/2002 | Keyes | |

OTHER PUBLICATIONS

Great Britain Search Report, dated Dec. 17, 2003 for Application No. GB 0321346.9.

* cited by examiner

*Primary Examiner*—Lee D. Wilson
*Assistant Examiner*—Anthony Ojini
(74) *Attorney, Agent, or Firm*—Conley Rose, P.C.

(57) ABSTRACT

An insert for use in a gripping assembly is disclosed. The insert includes a base member having a plurality of gripping teeth. The teeth are arranged in at least two substantially adjacent rows, where at least one row of teeth is offset or staggered longitudinally from an immediately adjacent row of teeth. When the teeth engage a cylindrical member, a resistance profile is created that is substantially continuous and does not oscillate over a length of the insert approaching 100% of the length of the entire insert.

20 Claims, 11 Drawing Sheets

JAW INSERT FOR GRIPPING A CYLINDRICAL MEMBER AND METHOD OF MANUFACTURE

CROSS-REFERENCE TO RELATED APPLICATIONS

The present application claims the benefit of U.S. Provisional Application Ser. No. 60/410,215 filed Sep. 12, 2002, entitled Jaw Insert for Gripping a Cylindrical Member and Method of Manufacture, which is hereby incorporated herein by reference.

STATEMENT REGARDING FEDERALLY SPONSORED RESEARCH OR DEVELOPMENT

Not applicable.

BACKGROUND OF THE INVENTION

1. Field of the Invention

The present invention relates to devices employed for powered rotation of cylindrical or tubular members. More particularly, the present invention relates to gripping jaw assemblies, such as those found in power tongs, back-ups, and wrenches, for applying controlled gripping force and rotational torque to a tubular member such as a drill pipe used in subterranean well applications.

2. Background of the Invention

Power devices used to attach ("make-up") and detach ("break-out") the threaded ends of tubular members such as pipe sections and the like are commonly known as power tongs or wrenches. Such power tongs or wrenches grip the tubular element and rotate it as the end of one element is threaded into the opposing end of an adjacent element or member. A device known as a back-up is typically used in conjunction with power tongs to hold the adjacent tubular element and prevent its rotation. Power tongs and back-ups are quite similar, the major difference being the ability of tongs to rotate the tubular element.

Power tongs and wrenches generally employ a plurality of gripping assemblies, each of which includes a jaw which moves radially toward a tubular element to engage the tubular element. In the case of power tongs and wrenches, the jaw is moved radially into engagement with the tubular element and then rotated concentrically about the axis of the tubular element in order to rotate the element and therefore make-up or break-out the joint. Various mechanisms have been used in the art to actuate the jaws. Power tongs generally include devices that use interconnected gears and camming surfaces, and may include a jaw assembly which completely surrounds the tubular element and constricts concentrically in order to engage the pipe. Wrench devices generally do not completely surround the tubular element, and include independent jaw assemblies wherein the jaw assemblies may be activated by multiple, opposing hydraulic piston-cylinder assemblies.

Damage occurring to the tubular member due to deformation, scoring, slipping, etc., caused by the jaws during make-up and break-out is always a matter of concern. This scoring is of particular concern when the tubulars are manufactured from stainless steel or other costly corrosion-resistant alloys. Undesirable stress and corrosion concentrations may occur in the tubulars in the tears and gouges that are created by the tong or wrench teeth. In addition, to maintain integrity of the threaded connection, it is desirable to reduce the deformation of the pipe caused by the power tongs and wrenches near the location of the threads, thus allowing more compatible meshing of the threads and reducing frictional wear.

Increasing these concerns is the movement in the industry, particularly the well drilling industry, toward the use of new tubular members that have finer threads than those traditionally employed. Finer threads means a smaller thread pitch, making break-out harder to achieve. For these reasons, among others, it is becoming industry standard to use higher torques when making up and breaking out pipe, casing, and other tubular sections. Using the same prior art equipment and methods that have traditionally been used on older pipe may cause severe problems when used on the newer tubulars having finer threads. Therefore, with the newer, finer threaded tubulars, it is necessary to provide gripping equipment that provides enough controlled force to penetrate the pipe material, but not so much so that the pipe is irreversibly damaged.

Gouging, scoring, marring, and tearing of the pipe is typically caused when the jaws of the tong or wrench slip. Slipping may be caused by a number of undesirable conditions which cause concentration of the gripping force applied by the tong or wrench. Generally, there are two sources of slipping: the jaw clamping system and the gripping teeth. First, imperfections and flexibility in the clamping system can cause insufficient contact between gripping teeth of the tong or wrench and the pipe. When the clamping force is applied by the mechanical or hydraulic system to the jaw body, the teeth (typically formed on an insert that is retained in the jaw) engage the pipe material. However, when the torquing force is applied, thereby causing rotation of the pipe sections, a reaction force is created which pushes back on the insert. Due to the continued application of rotational force and the flexibility inherent in the hydraulic, mechanical, and other holding systems, the inserts tend to advance along and move back slightly from the pipe surface. Pin tolerances and hydraulic fluid compressibility contribute to the inherent flexibility in the holding systems. Pipe material flexibility, or elasticity, also contributes to the overall flexibility which tends to cause the inserts to creep back from the pipe. Consequently, the teeth creep back from the pipe material until there is insufficient contact between the gripping teeth and the pipe, causing the jaws to slip and mar or gouge the pipe surface. Because it is difficult to achieve a system where the jaws do not move relative to the pipe material, even in a strictly mechanical system, conventional jaws allow undesirable slipping.

A second source contributing to jaw slippage is the shortcomings inherent in the gripping teeth, which are usually set in rows on jaw inserts. The inserts are typically removable from the jaw assembly so that they may be replaced when they become worn or otherwise ineffective. Generally, assuming the clamping system is able to maintain the teeth in engagement with the pipe material, the ability of the teeth to avoid slipping is a function of the resistance that they provide. Sometimes insert resistance is viewed in terms of the resistance or penetration profile of the insert. This resistance profile represents the contact with the pipe material provided by the gripping faces of a set of insert teeth as viewed from the front of the insert in the horizontal plane in which the teeth lie. For example, evidence of pipe-scoring in tubulars held by conventional teeth inserts clearly shows a teeth profile indicating that resistance is not spread over the entire length of the tooth insert. Such scoring shows raised portions of pipe material corresponding to the spaces between the teeth where no resistance is provided. When sets of insert teeth exhibit resistance profiles with areas of no resistance, such as with conventional teeth, jaw slippage is much more likely to occur.

Therefore, it is desirable for a power tong or wrench to compensate for its inherent flexibility to prevent detrimental scoring or other damage from occurring to the tubular. It is also desirable for the gripping jaw inserts to maintain a sufficient contact area between the teeth and the pipe, and to have a more evenly distributed and fuller resistance profile.

BRIEF SUMMARY OF PREFERRED EMBODIMENTS OF THE INVENTION

The embodiments described herein provide a gripping insert for use in a power tong or wrench for gripping a cylindrical member having at least two substantially adjacent rows of gripping teeth, where at least one row of teeth is offset or staggered longitudinally from an immediately adjacent row of teeth. The embodiments described herein provide a resistance or penetration profile that is substantially continuous and does not oscillate over a length of the gripping insert approaching 100% of the length of the entire insert.

In one embodiment, the gripping insert has at least two substantially adjacent rows of gripping teeth, where at least one row of teeth is offset or staggered longitudinally from an immediately adjacent row of teeth, and where the teeth in each substantially adjacent row are canted or angled in the same direction. In the present embodiment, the insert also provides a resistance or penetration profile that is substantially continuous and does not oscillate over a length of the gripping insert approaching 100% of the length of the entire insert.

In another embodiment, the gripping insert has at least two substantially adjacent rows of gripping teeth, where at least one row of teeth is offset or staggered longitudinally from an immediately adjacent row of teeth, and where the spaces between teeth in a given row are positioned diagonally relative to a given axis such that the spaces between immediately adjacent rows form diagonal rows of aligned spaces. In the present embodiment, the terminal edges of the spaces in a first row contact the terminal edges of the spaces in each immediately adjacent row. In the present embodiment, the insert also provides a resistance or penetration profile that is substantially continuous and does not oscillate over a length of the gripping insert approaching 100% of the length of the entire insert. The insert of the present embodiment is more easily manufactured using machining methods, whereas the previously described embodiments are more easily manufactured using investment casting technology.

The features and characteristics mentioned above, and others, provided by the various embodiments of this invention will be readily apparent to those skilled in the art upon reading the following detailed description of preferred embodiments, and by referring to the accompanying drawings.

NOTATION AND NOMENCLATURE

Figure 1:
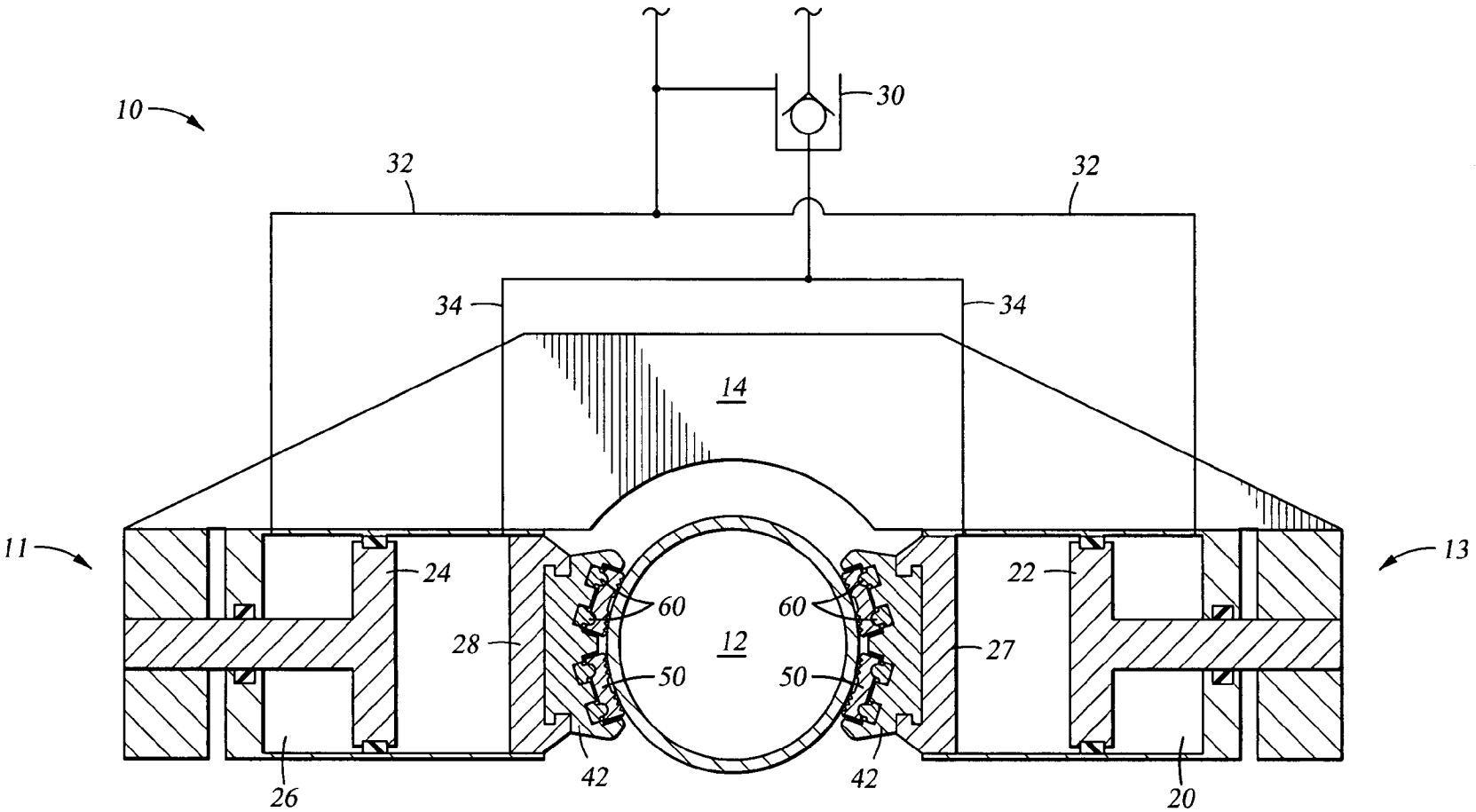
FIG. 1 is a top cross-section, partial schematic view of a torque wrench engaged with a tubular member.

In the following discussion and in the claims, the terms "including" and "comprising" are used in an open-ended fashion, and thus are to be interpreted to mean "including, but not limited to . . . ".

The present invention is susceptible to embodiments of different forms. There are shown in the drawings, and herein will be described in detail, specific embodiments of the present invention, including its use as a jaw insert with gripping teeth for gripping a cylindrical member. This exemplary disclosure is provided with the understanding that it is to be considered an exemplification of the principles of the invention, and is not intended to limit the invention to those embodiments that are specifically illustrated and described herein. In particular, various embodiments of the present invention provide a number of different constructions and methods of operation. It is to be fully recognized that the various teachings of the embodiments discussed below may be employed separately or in any suitable combination to produce desired results.

The terms "pipe," "tubular member," and the like as used herein shall include tubing and other generally cylindrical objects, such as logs and rods.

DETAILED DESCRIPTION OF THE PREFERRED EMBODIMENTS

Referring first to FIG. 1, a torque wrench 10 is shown engaged with tubular member or pipe section 12. Torque wrench 10 comprises a first jaw assembly 11 and a second jaw assembly 13, both supported by wrench body 14. Jaw assembly 11 comprises hydraulic piston cylinder 26, including jaw engaging portion 28, hydraulic piston 24, jaw body or insert holder 40, cams 60, and die inserts 50. Jaw assembly 13 comprises hydraulic piston cylinder 20, including jaw engaging portion 27, hydraulic piston 22, jaw body or insert holder 42, cams 60, and die inserts 50. Wrench 10 is shown having a wrench body 14 supporting two jaw assemblies 11, 13 that are circumferentially spaced about pipe 12 such that they oppose each other. However, it should be noted that there may be any number of such jaw assemblies disposed about pipe 12.

Hydraulic lines 32, 34 conduct hydraulic fluid between a hydraulic fluid reservoir (not shown) and piston cylinders 20, 26. Hydraulic lines are formed in or supported on body 14. Pilot operated check valve 30 controls the flow of hydraulic fluid, and, as shown in FIG. 1, is holding wrench 10 in the closed or gripping position.

Figure 2A:
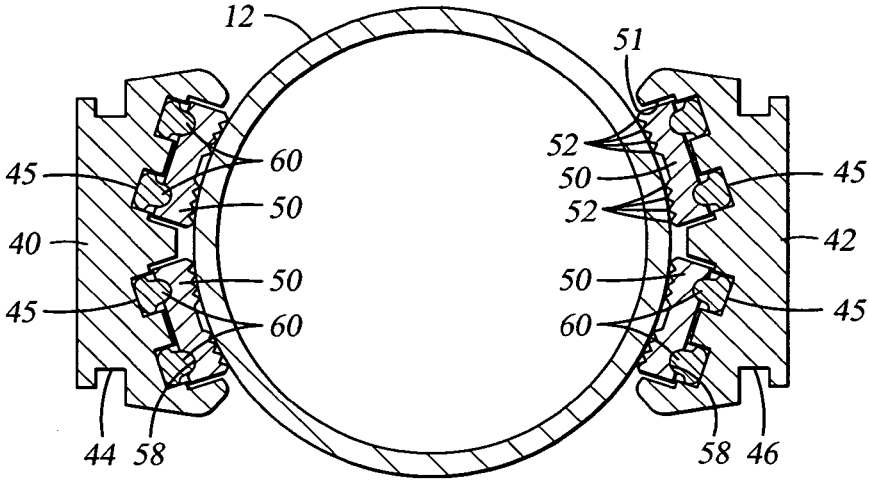
FIG. 2A is a top cross-section view of the jaw bodies of FIG. 1 with cammed die inserts engaged with a tubular member.

Referring now to FIG. 2, jaw bodies 40, 42, die inserts 50, and cams 60 are shown in the position in which pipe 12 is clamped within jaw bodies 40, 42, and where teeth 52 of die inserts 50 have come into initial engagement with pipe 12. Teeth 52 are shown slightly penetrating pipe 12, all at approximately the same depth. Jaw bodies 40, 42 include slots or recessed portions 45. Cams 60 are disposed within slots 45, and are rotatable about their longitudinal axes, which extend normal to the plane of the paper. Die inserts 50 are disposed within insert cavities 51 of jaw bodies 40, 42 and are movable from side to side within cavity 51. Die inserts 50 include two spaced-apart sets 54, 56 of teeth 52. Jaw bodies 40, 42 also have engagement slots 44, 46, respectively, so that jaw bodies 40, 42 may slide into and engage jaw engaging portions 27, 28 (FIG. 1).

Die inserts 50 also include C-shaped slots 58 extending longitudinally along the face of insert 50 opposite teeth 52. C-shaped slots 58 are adapted to receive the lobe 66 (see FIGS. 11A, B) of cam 60 such that rotational movement of cam 60 is allowed about its longitudinal axis. Preferably, the contact surfaces between lobe 66 and slot 58 are substantially smooth and uniform so as to allow unimpeded movement between cam 60 and insert 50. In this case, cam 60 and insert 50 may be supported by means described more fully hereinbelow. Alternatively, the contact surfaces between cam 60 and insert 50 may be adapted so as to connect cam 60 and insert 50 and still allow movement relative to each other, thereby eliminating the need for a support means between insert 50 and any other structure, such as a locking plate as described below. For example, a means for releasably attaching insert 50 and cam 60 may include male, T-shaped tracking edges on either of the contact surfaces which would slide into female grooves on the other surface.

Figure 2B:
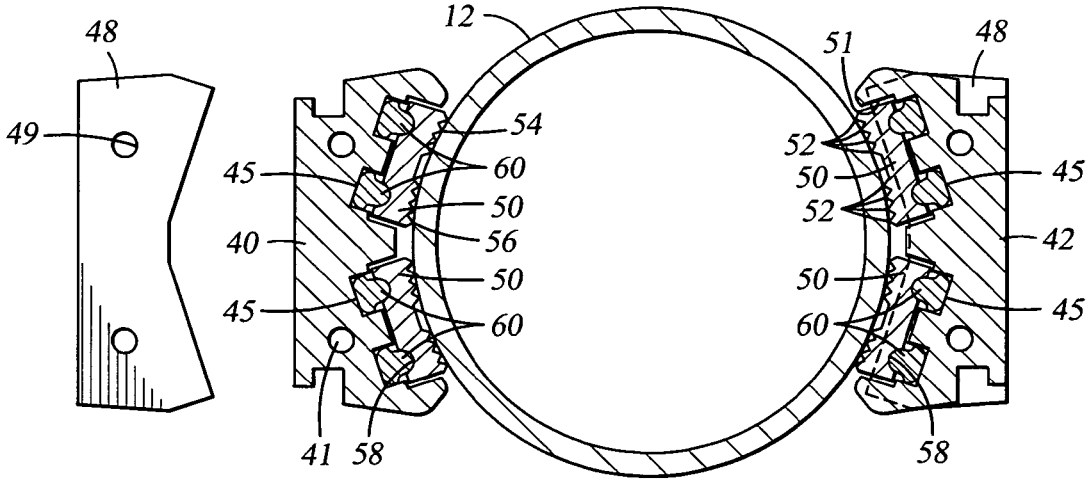
FIG. 2B is a top cross-section view of the jaw bodies of FIG. 2A including a top locking plate.

Referring now to FIG. 2B, locking plate 48 is shown. A first plate 48 is shown separated from jaw body 40, and a second plate 48 engaged with jaw body 42. Each plate 48 includes apertures 49 which are aligned with slots 41 in jaw body 40 when plate 48 is engaged with body 40. Attaching means, such as pins or screws (not shown), are inserted into the aligned aperture 49 and slot 41 so as to attach plate 48 to jaw bodies 40, 42. Typically, a locking plate 48 will be attached to both the tops and bottoms of jaw bodies 40, 42. Locking plates 48 prevent cams 60 and inserts 50 from moving longitudinally within slots 45 and cavities 51, respectively. To further maintain cams 60 within slots 45, protrusions or pins (not shown) may extend longitudinally from plates 48 into cams 60. These protrusions or pins may extend partially into cams 60, or, alternatively, extend the full length of cams 60. Preferably, the pins would be aligned and parallel with, or coincident with, the longitudinal, central axis of cams 60 so that cams 60 rotate properly within slots 45. To further maintain inserts 50 within cavities 51, similar protrusions or pins (not shown) may be supported by plate 48 and extend into inserts 50. However, because inserts 50 may move side to side within cavity 51, inserts 50 must provide elongated slots to receive the protrusions or pins, the elongated slots being shaped to allow such movement.

In addition to the above described means of maintaining cams 60 and inserts 50 within slots 45 and cavities 51, respectively, alternative means may also be employed to achieve the same results. Instead of employing pins or protrusions supported by plates 48 and extending into cams 60 or inserts 50, cams 60 and inserts 50 may include protrusions extending longitudinally into slots provided in plates 48. Alternatively, the cavities 51 may be shaped such as to hold inserts 50 in place and thereby also holding cams 60 in place. One way to achieve this would be to angle the side walls of cavities 51 inward toward inserts 50 so as to pinch or engage longitudinal slots in the sides of inserts 50. However, this would tend to impede the side to side movement of inserts 50 within cavities 51, and therefore may not be as desirable as the above-described means.

It should be noted that teeth 52 of FIGS. 1–4 are generally of the type seen in FIG. 8 (to be described in more detail hereinafter). Conventional teeth, such as the ones shown in FIG. 7, may also be used with wrench 10 and jaw assemblies 11, 13. Thus, the present invention may employ conventional teeth or one of the newly-designed teeth arrangements seen in FIGS. 8–10.

Figure 3A:
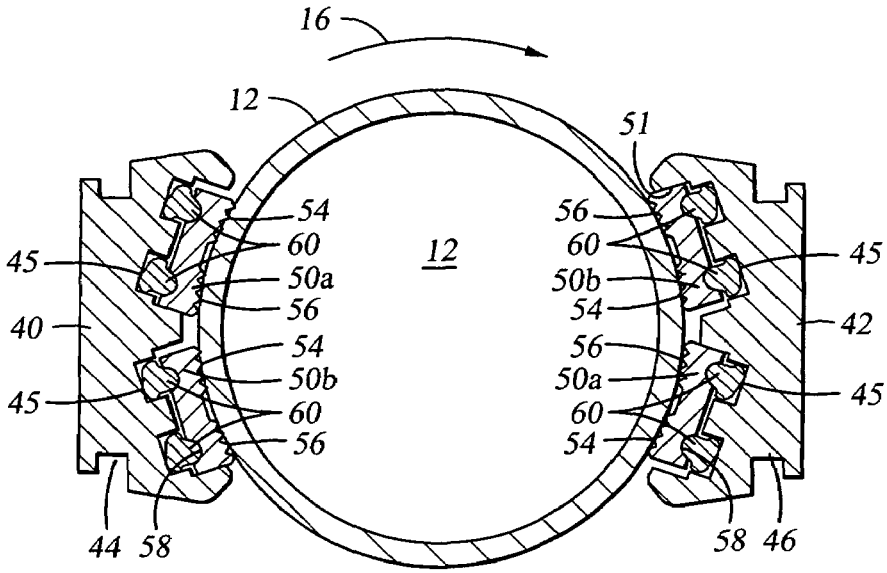
FIG. 3A is a top cross-section view of the jaw bodies with cammed die inserts after a rotational torquing force has been applied to the jaw body in the clockwise direction.
Figure 3B:
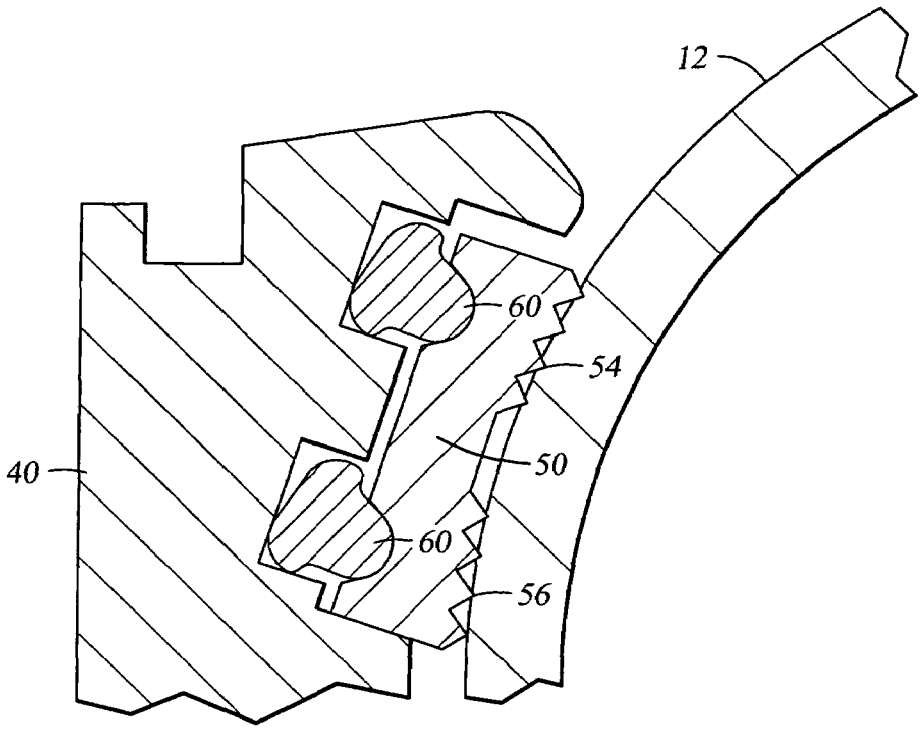
FIG. 3B is an enlarged view of a portion of one of the jaw bodies of FIG. 3A.

Referring next to FIGS. 3A–4B, jaw bodies 40, 42, die inserts 50, and cams 60 are shown in adjusted positions (relative to FIG. 2) in response to a rotational torquing force. In FIG. 3A, the rotational torquing force is applied in the clockwise direction (typically for make-up), as shown by arrow 16. In FIG. 4A, the rotational torquing force is applied in the counter-clockwise direction (typically for break-out), as shown by arrow 18. After the rotational torquing force has been applied, the teeth sets 54, 56 protruding from die inserts 50 become distinguishable from each other by the additional amount of penetration into pipe 12 achieved due to the rotational torquing force. More specifically, as seen in FIGS. 3A and B, the rotational torquing force 16 causes teeth sets 54 to further penetrate pipe 12 relative to teeth sets 56. In FIGS. 4A and B, the counter-clockwise rotational force 18 causes teeth sets 56 to further penetrate pipe 12 relative to teeth sets 54.

It should also be noted that die insert 50 may be formed as a single piece, where teeth sets 54, 56 are an integral part of insert 50. Alternatively, insert 50 may be formed in separate portions, wherein insert 50 comprises a base portion adapted to receive separately formed teeth inserts 54, 56 that are attached to the base portion.

Cams 60 are rotatable within slots 45, and therefore rotate about their longitudinal axes in response to the rotational torquing forces 16, 18. Thus, cams 60 can be seen rotated slightly in a clockwise direction from their original position in FIG. 3A, and in a counter-clockwise direction from their original position in FIG. 4A.

Figure 11A:
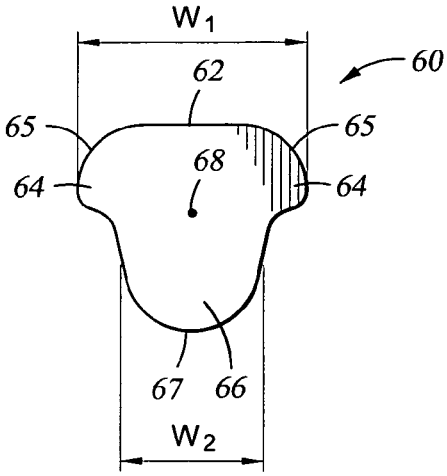
FIG. 11A is a top plan view of a camming member.
Figure 11B:
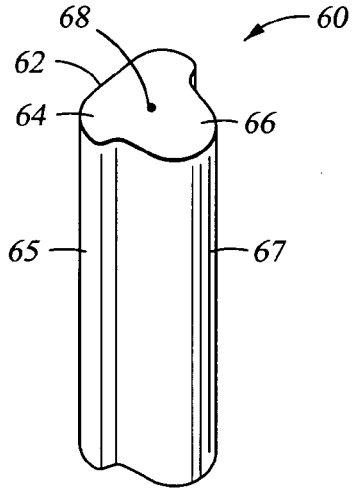
FIG. 11B is a perspective view of the camming member of FIG. 11A.

Referring now to FIG. 11, a cam 60 is shown isolated from jaw bodies 40, 42. Cam 60 of FIG. 11A comprises an elongated base portion 62 which curves into legs 64. Legs 64 provide for jaw camming surfaces 65. Extending from base 62 is lobe 66. Lobe 66 provides for insert camming surface 67. Cam 60 is rotatable about its longitudinal axis 68. The width $W_1$ is the width of base portion 62 while width $W_2$ is the width of lobe 66. $W_2$ is wider than $W_1$ as shown in FIG. 11A. Although FIGS. 1–4 show cams 60 in accordance with the enlarged cams of FIG. 11, it should be understood that cams 60 may be any shape such that there are two camming surfaces, with one being in contact with jaw bodies 40, 42 and one being in contact with inserts 50.

Figure 5:
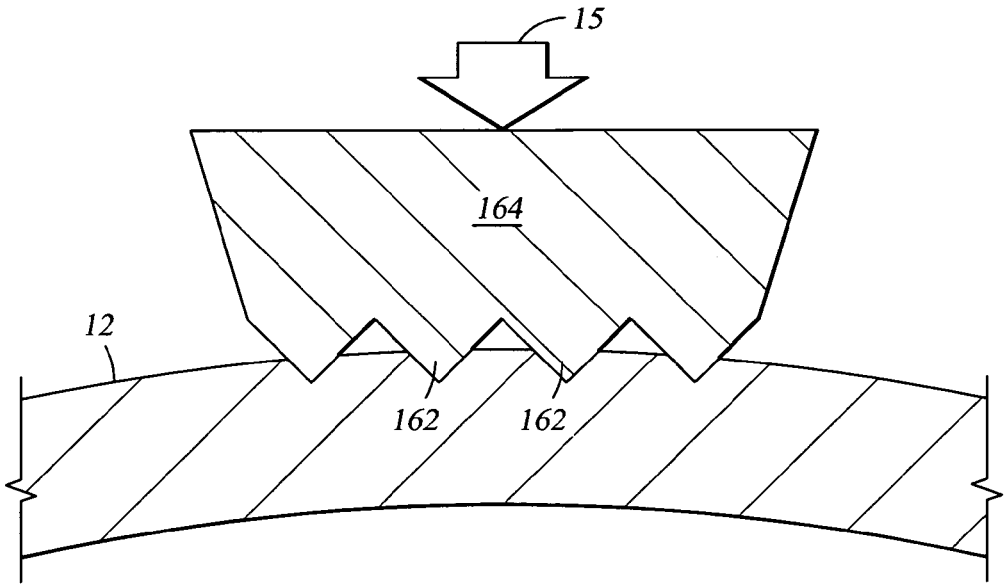
Fig. 5 (PRIOR ART)
FIG. 5 is a top cross-section view of conventional die insert teeth engaged with a tubular member.
Figure 6:
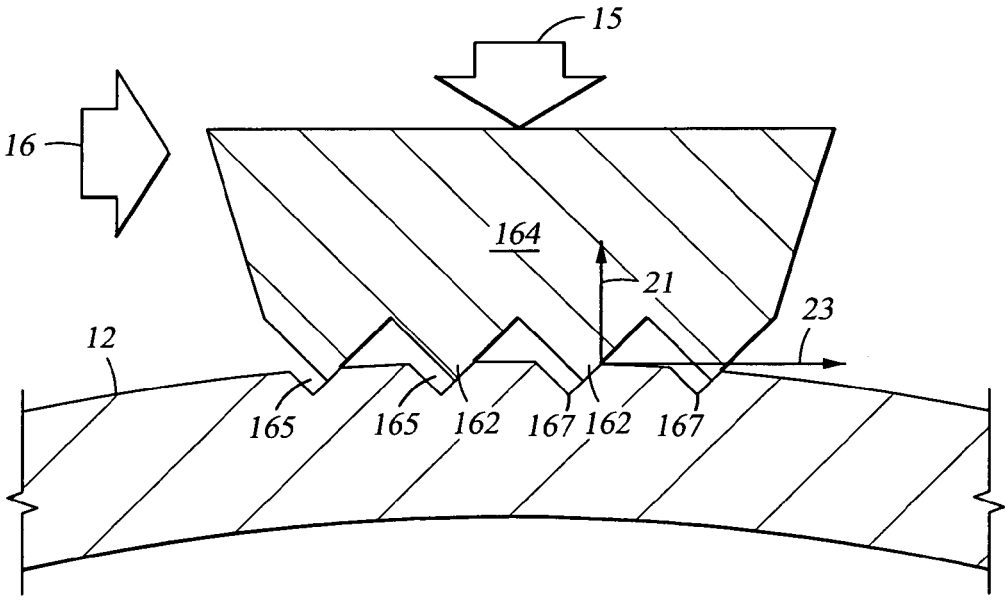
Fig. 6 (PRIOR ART)
FIG. 6 is a top cross-section view of conventional die insert teeth partially engaged with a tubular member after a rotational torquing force has been applied using prior art devices and methods.

Before operation of torque wrench 10 is described, reference is made to FIGS. 5 and 6. In FIG. 5, conventional tooth set 164 is shown engaging pipe 12. Force 15 is applied to wrench 10 normal to pipe 15 so that teeth 162 engage and penetrate pipe 12. This provides the gripping action required to later rotate pipe 12. Subsequently, as seen in FIG. 6, rotational torquing force 16 is applied to wrench 10 and transferred to tooth set 164 and teeth 162. As seen in FIG. 6, flexibility in the hydraulic and mechanical systems used to apply the forces 15, 16, increased reaction forces caused by pipe 12, and inadequate resistance to slippage by teeth 162 combine to cause teeth 162 to move back from pipe 12 in prior art gripping devices. Arrow 21 shows that teeth 162 retreat from pipe 12 while arrow 23 shows that teeth 162 move laterally with respect to pipe 12, thereby creating gaps 165 between teeth 162 and pipe 12. When the contact area between teeth 162 and pipe 12 is critically reduced, the teeth slip out of their previously formed grooves 167, causing the entire wrench 10 to slip. As mentioned before, this type of slipping scores and damages pipe 12, which is undesirable and is common with prior art power tongs, wrenches, and die inserts.

Referring again to FIGS. 1–4, and additionally to FIG. 11, the operation of torque wrench 10 will now be described. When die inserts 50 are not engaged with pipe 12, wrench 10 is in the open position. To maintain the open position, pilot operated check valve 30 directs high pressure hydraulic fluid into piston cylinders 20, 26 through hydraulic fluid line 32. To close wrench 10 and engage pipe 12, pilot operated check valve 30 redirects high pressure hydraulic fluid through line 34, thereby causing piston cylinders 20, 26 to move toward pipe 12. Once the appropriate amount of clamping force has been applied, the components of wrench 10 assume the positions as shown in FIG. 2. It should be noted that the operation of torque wrench 10 may vary according to the physical system used, such as cam-operated mechanical arms or leveraged, self-locking mechanical arms.

Once wrench 10 has engaged pipe 12, wrench 10 may be used to either make-up or break-out sections of pipe 12. Make-up or break-out is done by imparting a rotational force to wrench 10 using a torquing device (not shown). In FIG. 3A, a clockwise force 16 has been applied, typically used during pipe make-up. Force 16 causes jaw bodies 40, 42 to rotate clockwise. Because die inserts 50 are held in place by teeth 54, 56, cams 60 rotate clockwise until leading inserts 50*a* come into contact with the inner side of cavity 51 and trailing inserts 50*b* come into contact with the outer side of cavity 51. At this point, the combination of clamping force 15 and rotational force 16 (previously shown in FIGS. 5 and 6) causes leading teeth 54 of inserts 50 to penetrate further into pipe 12 than trailing teeth 56. The increased penetration by teeth 54 and the flexibility of the hydraulic and mechanical systems of wrench 10 make the "creep-back" phenomenon explained with reference to FIG. 6 likely, yet undesirable. However, due to the specially designed cams 60 as previously described and shown in FIG. 11, this phenomenon can be avoided without regard to the type or design of the inserts and/or teeth. Due to their special shape and their ability to rotate within slots 45, cams 60 are able to redirect portions of the forces applied to insert 50 in such a way as to oppose the unwanted movement of insert 50 (as represented by the arrows 21, 23 in FIG. 6). Rotation of wrench 10 activates cams 60, whereby the mechanical force created by the movement and positioning of cams 60 enhances the force provided by the hydraulics of the clamping system. Consequently, cams 60 compensate for the flexibility in the holding systems and pipe material by mechanically intensifying the gripping force. Thus, even after force 16 has been applied, teeth 52 remain substantially engaged with pipe 12 as seen in FIG. 5 and "creep-back" is eliminated or reduced substantially.

To illustrate further, upon clamping, the pressure in a wrench or clamp system may be approximately 3,000 psi, for example. Once torquing occurs, the pressure in the system may increase approximately 1,000 psi, from 3,000 to 4,000 psi, due to the mechanical push-back force represented by arrow 21 in FIG. 6. Cams 60 compensate for push-back force 21 and the increased pressure to ensure that teeth 52 do not move out of engagement with pipe material 12. Cams 60 assist wrench 10 in achieving the benefit of increased teeth penetration force, and thereby maintaining teeth engagement. Preventing teeth "creep-back" decreases slippage, thereby reducing the likelihood of detrimental gouging, scoring, or marring of the pipe surface.

Figure 4A:
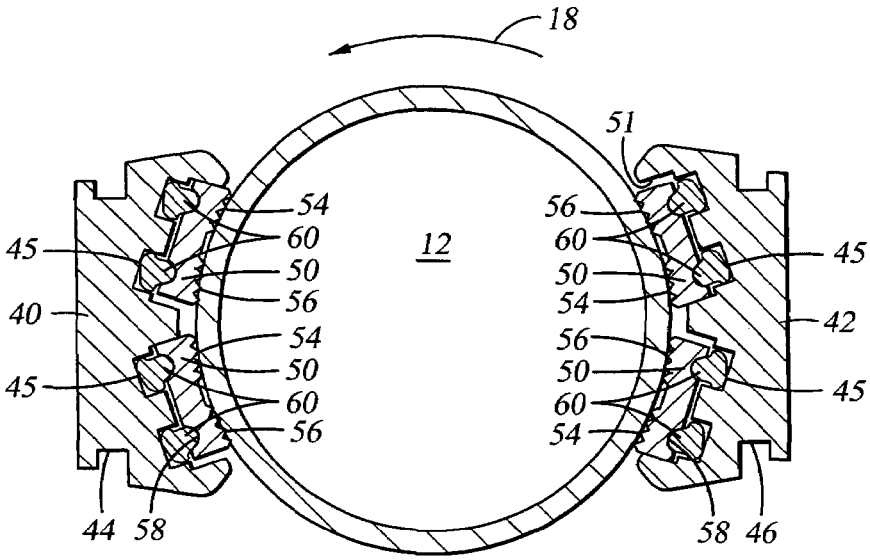
FIG. 4A is a top cross-section view of the jaw bodies with cammed die inserts after a rotational torquing force has been applied to the jaw body in the counter-clockwise direction.
Figure 4B:
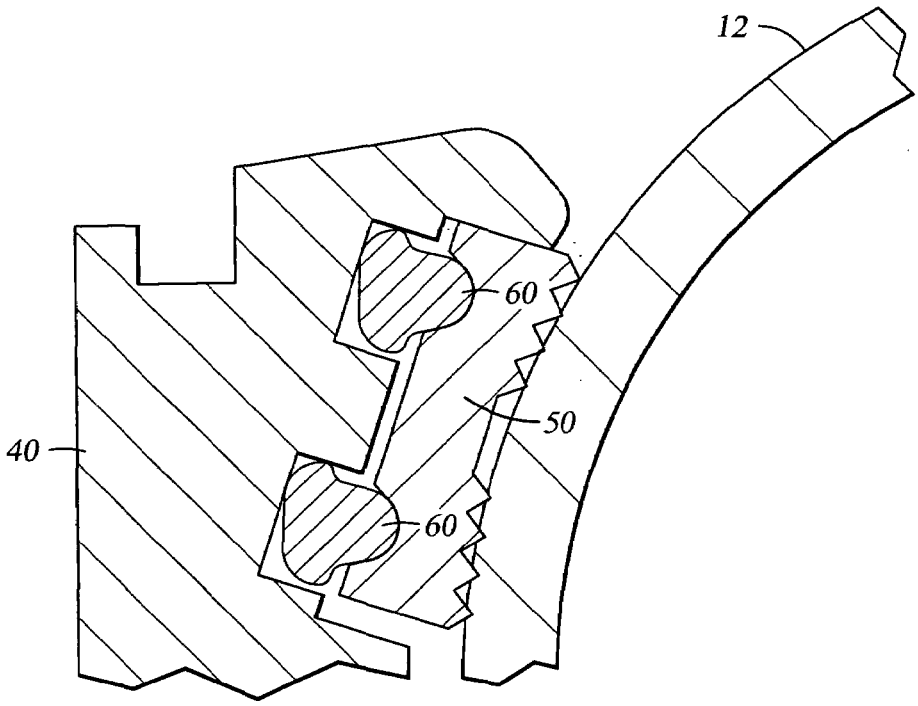
FIG. 4B is an enlarged view of a portion of one of the jaw bodies of FIG. 4A.

For break-out of pipe sections, a force 18 may be applied as seen in FIG. 4A. Operation of wrench 10 is the same as previously described with make-up, except that the movements of cams 60, inserts 50, etc. are opposite of those described above. Because cams 60 may rotate within slots 45, they are equally adapted to maintaining the stability of inserts 50 during break-out as during make-up.

Generally, there are two conventional types of clamping systems: a camming system with tongs, where the cam and camming surface are an integral part of the movement used to bring the die inserts into contact with the pipe surface, and a jaw system, where camming surfaces are not typically used. Several embodiments of the present invention combine features of these two, whereby a hydraulic jaw/piston-cylinder system closes the system and the cams hold the teeth inserts in engagement with the pipe material. Instead of initiating the camming mechanism to advance the die inserts toward the pipe surface, the hydraulic piston-cylinder system is used to advance the inserts while the camming mechanism only moves in reaction to the rotational torquing forces in order to hold the teeth steady within the penetrated pipe material. The embodiments described herein combine elements of each system to advance the capabilities presently found in wrench systems such that the "creep-back" problem is eliminated.

Referring to FIGS. 7 through 10, sets of insert teeth are shown in various arrangements. FIG. 7A illustrates a conventional insert 70 having chisel-shaped insert teeth 72. Insert teeth may be any number of shapes, such as pyramidal or polygonal, with the entire insert typically machined from steel. Shown in FIG. 7A are chisel-shaped teeth 72 having first gripping faces 73, second gripping faces 75, and side faces 77, 79. Teeth 72 are formed in rows 74 with valleys or gaps 78 in between each tooth 72 as formed by the sloping sides faces 77, 79. Insert 70 includes four rows 74 having twenty teeth 72 each, although set 70 may have any number of rows 74 and any number of teeth 72. Furthermore, conventional insert 70 has a longitudinal axis X and perpendicular axis Y. Rows 74 run parallel to longitudinal axis X. Teeth 72 also form columns 71 parallel to axis Y, meaning that teeth 72 and gaps 78 are substantially aligned in the Y direction. The width Because gaps 78 are aligned, the resistance provided by conventional insert 70 can generally be represented as resistance profile 76.

Width a shown in resistance profile 76 generally represents the shear width of each tooth 72, which can also be expressed as the length of the crest of each tooth 72. Because valleys 78 are aligned in the Y direction, the effective resistance length of conventional insert 70 is width a multiplied by the total number of teeth in row 74. When the width a of each tooth 72 is multiplied by the total number of teeth in row 74, it can be shown that the effective resistance length of conventional insert 70 is approximately 50% of the total length of insert 70.

For exemplary purposes, assume width a is 0.150 inches, the number of teeth 72 in each row 74 is twenty, and the total length of the insert is approximately 6.000 inches. In this case, the effective resistance length of insert 70 is 0.150×20=3.000 inches, which is approximately 50% of the length of insert 70.

Figure 7A:
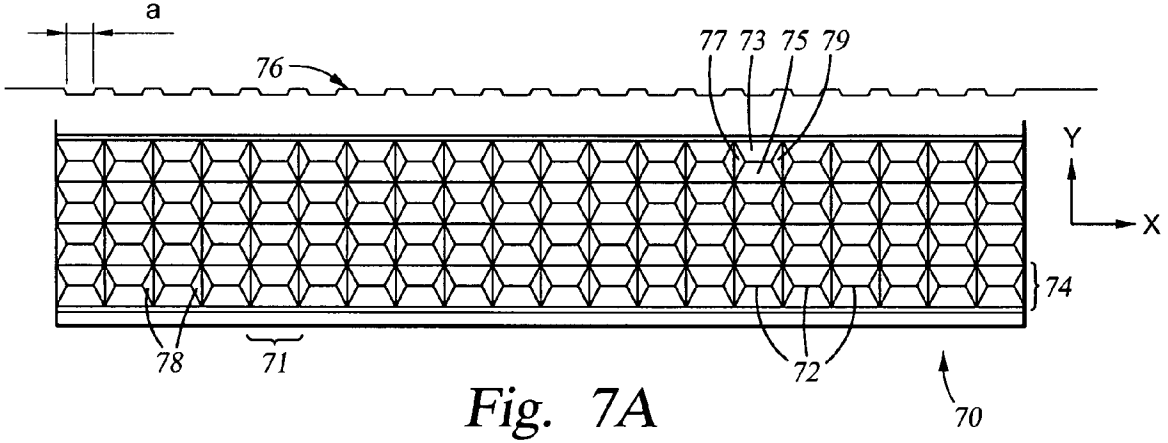
Fig. 7A (PRIOR ART)
FIG. 7A is a top plan view of a set of prior art die insert teeth.
Figure 8B:
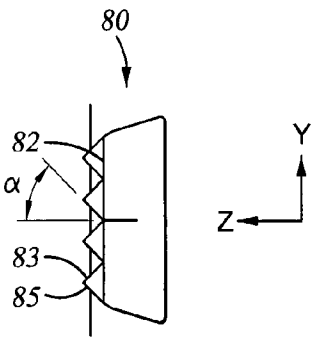
FIG. 8B is a side plan view of the die insert teeth of FIG. 8A.
Figure 8A:
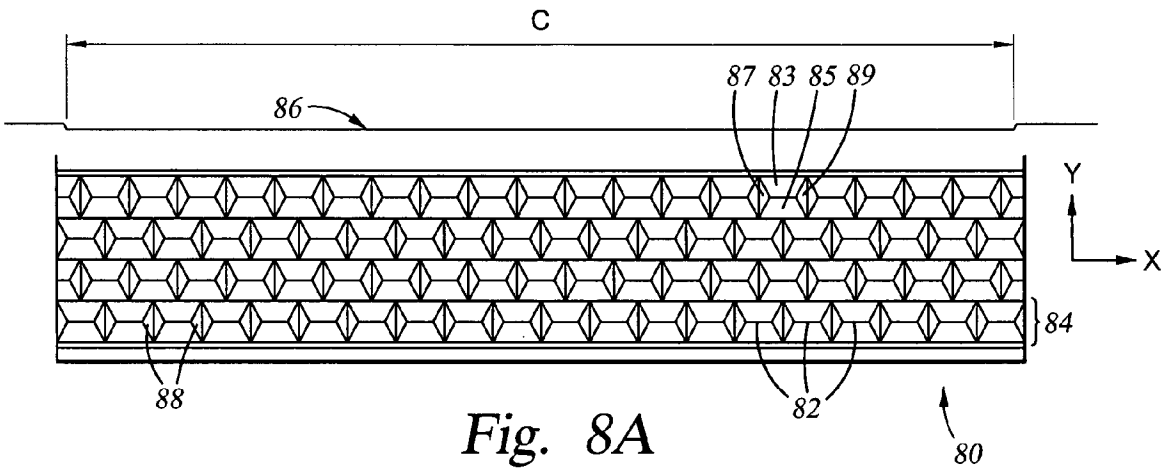
FIG. 8A is a top plan view of a set of die insert teeth with rows of teeth offset longitudinally in accordance with one embodiment of the present invention.
Figure 12A:
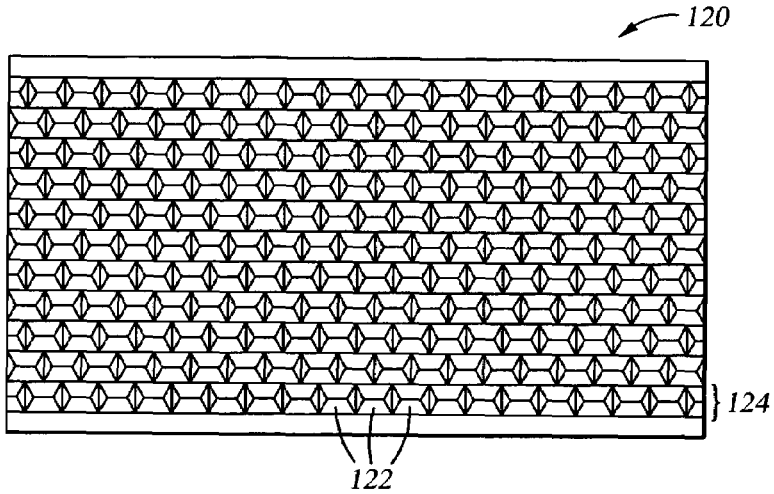
FIG. 12A is a top plan view of an alternative embodiment of the die insert teeth of FIG. 8A.
Figure 12B:
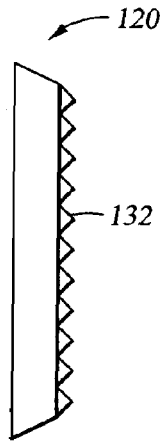
FIG. 12B is a side plan view of the die insert teeth of FIG. 12A.

Referring now to FIG. 8A, insert 80 is shown and comprises teeth 82 having first gripping faces 83, second gripping faces 85, and side faces 87, 89. Teeth 82 are formed in rows 84 with spaces 88 in between each tooth 82 as formed by the sloping side faces 87, 89. Again, insert 80 may have any number of teeth 82 and rows 84, as can be seen in FIGS. 12A and B wherein teeth 122 of insert 120 lie in numerous rows 124. Referring again to FIG. 8A, teeth 82 in rows 84 lie in the plane defined by longitudinal axis X and perpendicular axis Y. However, unlike insert 70 of FIG. 7A, set 80 has rows 84 which have teeth 82 that are offset in the longitudinal direction from the teeth of each adjacent row 84. Thus, teeth 82 no longer form uninterrupted columns in the Y direction. Thus, in insert 80, teeth 82 in a given row and in a given position relative to the X axis may be said to be offset or staggered from the teeth 82 in each adjacent row 84. Likewise, in insert 80, gaps 88 in a given row 84 are no longer aligned in the Y direction with gaps 88 in each adjacent row.

Figure 7B:
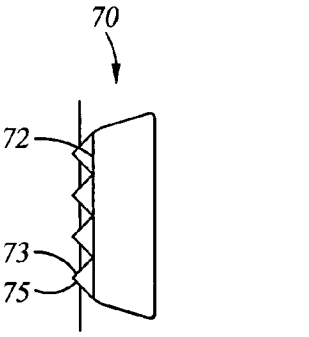
Fig. 7B (PRIOR ART)
FIG. 7B is a side plan view of the die insert teeth of FIG. 7A.

Although the shear width of each individual tooth 82 in insert 80 remains the same as that of each individual tooth 72 in insert 70 of FIG. 7, the new resistance profile 86 of FIG. 8A shows an effective resistance length that extends approximately the entire length of insert 80, and can be represented by the dimension c. Resistance profile 86 represents the contact with the pipe material provided by the gripping faces 83, 85 as viewed from the front or rear of insert 80 in the plane defined by axes X and Y. The oscillating resistance profile 76 of insert 70 of FIG. 7A reflects the fact that gaps 78 in insert 70 are all aligned in the Y direction, and thus do not provide resistance between each width a of teeth 72. Resistance profile 86 of insert 80, however, reflects that each gap 88 is substantially aligned in the Y direction with a tooth 82 in each adjacent row 84, whereby the several rows 84 of insert 80 provide slipping resistance across approximately the entire length of insert 80. It should be noted that FIG. 8A shows each row 84 is offset by approximately one-half of a tooth 82 width from each adjacent row 84, meaning that the tooth 82 of every other row 84 is aligned. However, each row 84 may be offset from each adjacent row 84 by something more or less than one-half of a tooth 82 width, but preferably only in such a way that the resistance profile 86 is created.

The new resistance profile 86 shown in FIG. 8A shows a new effective resistance length c which spans the entire length of the insert 80. Using the same exemplary dimensions discussed previously, the effective resistance length of insert 80 is approximately 6.000 inches, a two-fold increase over the effective resistance length of insert 70 of FIG. 7A. This increased resistance length provides more effective resistance to insert slippage, especially in applications with smaller diameter pipes. Thus, while conventional insert 70 can be employed with the wrenches, jaws, and other clamping devices of FIGS. 1–4B, 9C, and 14A–15B, improved performance is achieved with use of insert 80 and other inserts that provide greater effective resistance to slippage than does conventional insert 70.

It is very difficult to manufacture the shifted or offset teeth, such as the ones described above and shown in FIG. 8A, especially when using traditional machining methods. However, investment casting techniques may be used to cast the die inserts, such as inserts 80. The die inserts 80 (and all other inserts described herein) may be cast from steel and polished, thereby achieving similar quality and finish as with machined inserts, but in a more efficient manner considering the improved tooth design.

As seen in FIGS. 7 and 8, the teeth 72, 82 are chisel-shaped with spaces 78, 88 between them. The spaces 78, 88 allow penetrated pipe material to move, i.e., to be displaced to an area of less resistance. With a solid edge, i.e., a single tooth that extends the length of the insert in the X direction without any spaces such as spaces 78, 88, penetration of the teeth into the pipe material is limited because of a lack of space to accommodate the displaced pipe material. Thus, even though an effective resistance length approaching 100% of the entire length of the insert (100% resistance profile) is desirable, such as can be achieved with a single tooth that extends the length of the insert in the X direction, a single tooth solid edge is undesirable because the proper amount of pipe material penetration cannot be achieved. As a result of the offset design of FIG. 8A, a resistance profile similar to that of a solid edge (100% resistance profile) may be achieved while maintaining spaces 88 for pipe material displacement. While insert 70 of FIG. 7A has spaces 78, insert 70 only has an approximately 50% resistance profile.

Figure 9B:
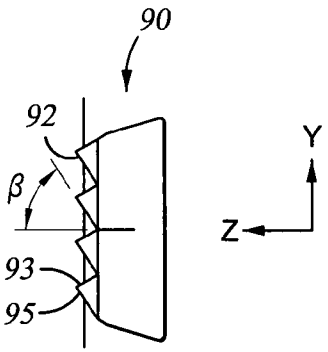
FIG. 9B is a side plan view of the die insert teeth of FIG. 9A.
Figure 9A:
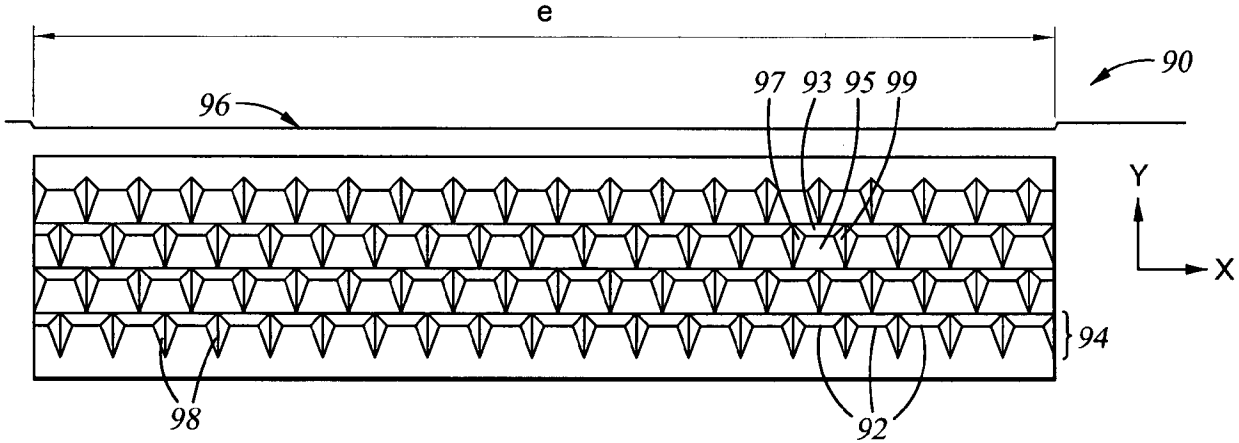
FIG. 9A is a top plan view of a set of die insert teeth offset longitudinally and angled in accordance with another embodiment of the present invention.

Referring now to FIG. 9, another embodiment of the present invention is shown. FIG. 9A shows that insert 90 comprises teeth 92 having first gripping faces 93, second gripping faces 95, and side faces 97, 99. Teeth 92 are formed in rows 94 with spaces 98 in between each tooth 92 formed by the sloping side faces 97, 99. Again, insert 90 may have any number of teeth 92 and rows 94. The resistance profile 96 of this embodiment is similar to resistance profile 86 of FIG. 8A, with its dimension represented by the dimension e.

However, unlike teeth 82 in FIG. 8, teeth 92 are angled relative to the Z axis of FIG. 9B. Referring still to FIG. 9B, it can be seen that the area of face 93 of teeth 92 is smaller than the area of face 95, causing chisel-shaped tooth 92 to be canted toward or angled toward gripping face 93.

Figure 9C:
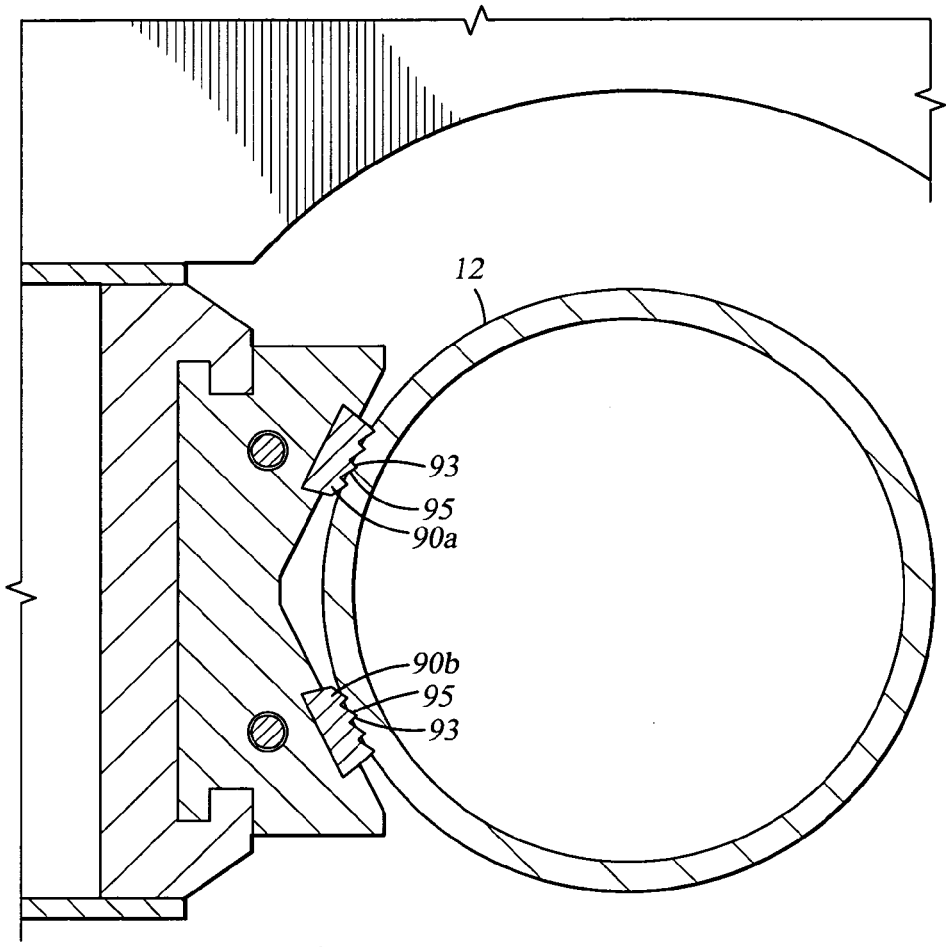
FIG. 9C is an enlarged, top cross-section view of a conventional jaw body including the die insert teeth of FIGS. 9A and B.

Although the resistance profile 96 is similar to that of the embodiment in FIG. 8A, the embodiment in FIG. 9 will produce the most actual resistance to slipping when gripping face 93 is the leading face on the leading insert 90 when a rotational torque has been applied, i.e., when the rotational force acting upon insert 90 is substantially in the same direction as the direction that gripping face 93 faces. For example, referring to FIG. 9C, the die inserts 90*a* and 90*b* are positioned such that gripping faces 93 of insert 90*a* face away from gripping faces 93 of insert 90*b*. In this arrangement, teeth 92 of inserts 90*a* and 90*b* may be described as being canted in opposite directions, and as extending opposite or away from one another. Positioning inserts 90*a, b* this way will produce the greatest actual resistance to slipping, which is significant because the combination clamping and rotational forces acting upon die inserts 90*a, b* will bear substantially on the die insert 90*a* when a clockwise rotational force (make-up) is being applied by wrench 10, or die insert 90*b* when a counter-clockwise (break-out) rotational force is being applied by wrench 10. Thus, whether wrench 10 is being used for make-up, as in FIG. 3, or break-out, as in FIG. 4, the leading sides of die inserts 90*a, b* will always have a substantial number of gripping faces 93 facing the same general direction as the rotational torque. Once again, teeth 92 in each row 94 are staggered or offset with respect to teeth 92 in at least one (and preferably both) adjacent rows 94.

Figure 10B:
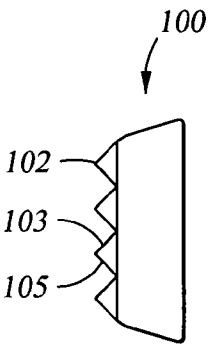
FIG. 10B is a side plan view of the die insert teeth of FIG. 10A.
Figure 10A:
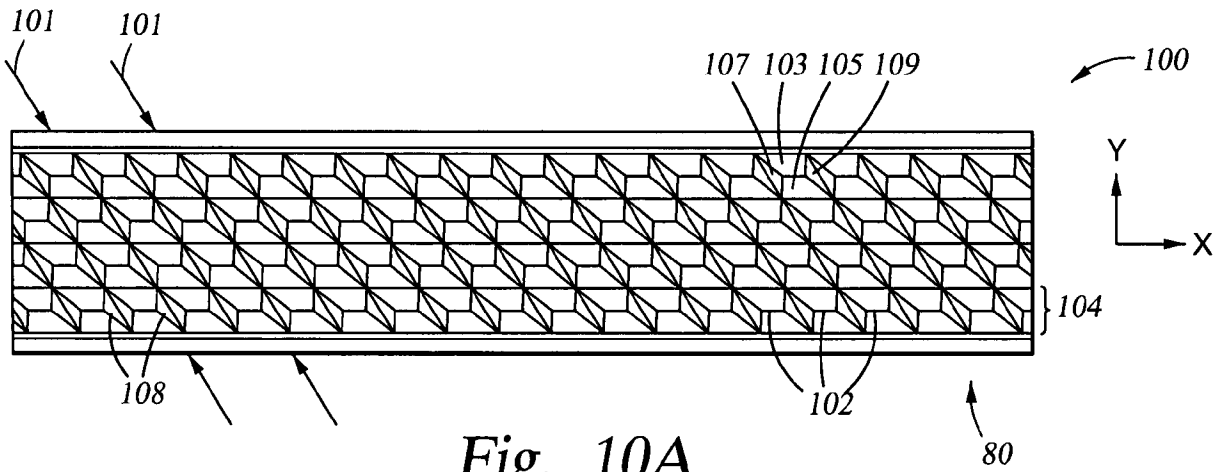
FIG. 10A is a top plan view of a set of die insert teeth offset longitudinally in accordance with yet another embodiment of the present invention.
Figure 13A:
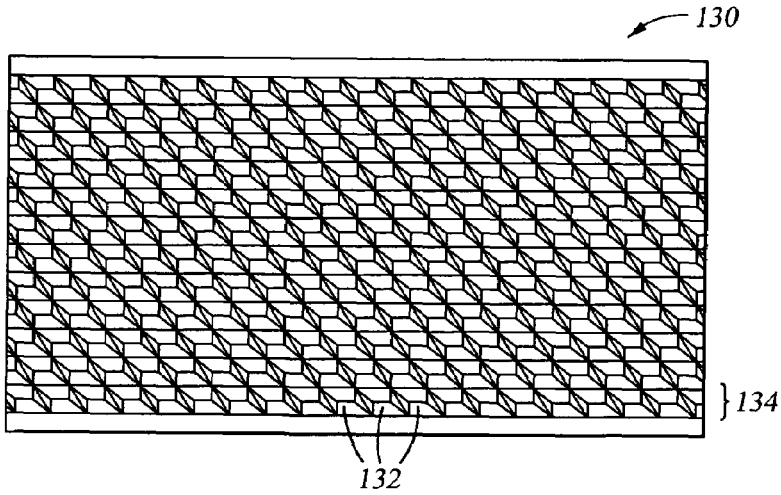
FIG. 13A is a top plan view of an alternative embodiment of the die insert teeth of FIG. 10A.
Figure 13B:
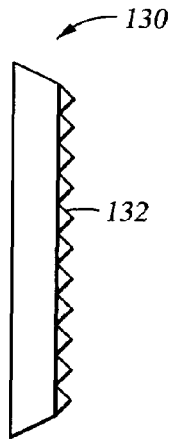
FIG. 13B is a side plan view of the die insert teeth of FIG. 13A.

Referring next to FIG. 10, yet another embodiment of the present invention is shown. Insert 100 comprises teeth 102 having first gripping faces 103, second gripping faces 105, and side faces 107, 109. Teeth 102 are formed in rows 104 with spaces 108 in between each tooth 102 formed by the sloping side faces 107, 109. FIGS. 13A and B show that rows 104 may be formed in any quantity, such as rows 134 of insert 130. The resistance profile for this embodiment will look substantially similar to the resistance profile 86 of FIG. 8A. Furthermore, the side view of FIG. 10B is also substantially similar to the side view seen in FIG. 8B. Also, similar to spaces 88 in FIG. 8A which are not aligned in the Y direction with spaces 88 in immediately adjacent rows 84, spaces 108 are not aligned in the Y direction with spaces 108 in immediately adjacent rows 104. However, each space 88 is independently aligned in the Y direction whereas each space 108 is positioned diagonally relative to the axis Y. This design forms diagonal rows 101 of aligned spaces 108 and may be manufactured using the investment casting technology used in manufacturing the previous embodiments, but is particularly suited for ease of manufacture when machining. Thus, in insert 100, teeth 102 in each row 104 is offset a given measure in the X direction from teeth 102 in the immediately adjacent row 104, but the amount of offset is less than the length of a tooth 102. In this arrangement, spaces 108 in a given row are offset a given measure in the X direction from the spaces 108 in the immediately adjacent rows 104. That given measure is chosen such that the terminal edges of spaces 108 in a first row contact the terminal edges of spaces 108 in each immediately adjacent row. Rows 101 may be formed at an angle relative to the Y axis of between approximately 10 and 45°.

It should be noted that the teeth in any of the embodiments in FIGS. 8–10 may be designed in any shape, and multiple shapes may be present within any set of teeth on an insert. It is important, however, that the gaps and spaces between the teeth be present because, as mentioned before, a solid edge is undesirable.

Figure 14A:
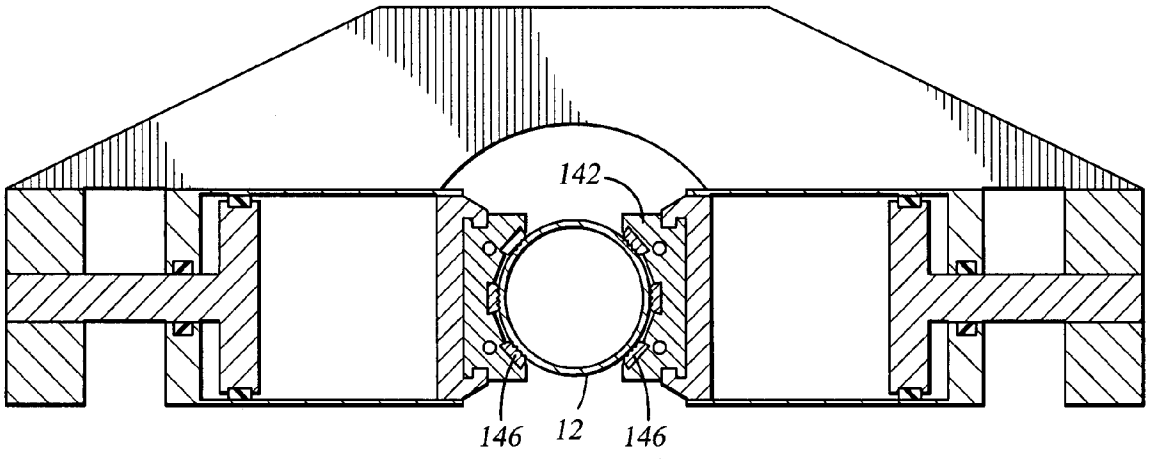
FIG. 14A is a top cross-section view of a torque wrench having a conventional jaw body with die inserts.
Figure 15A:
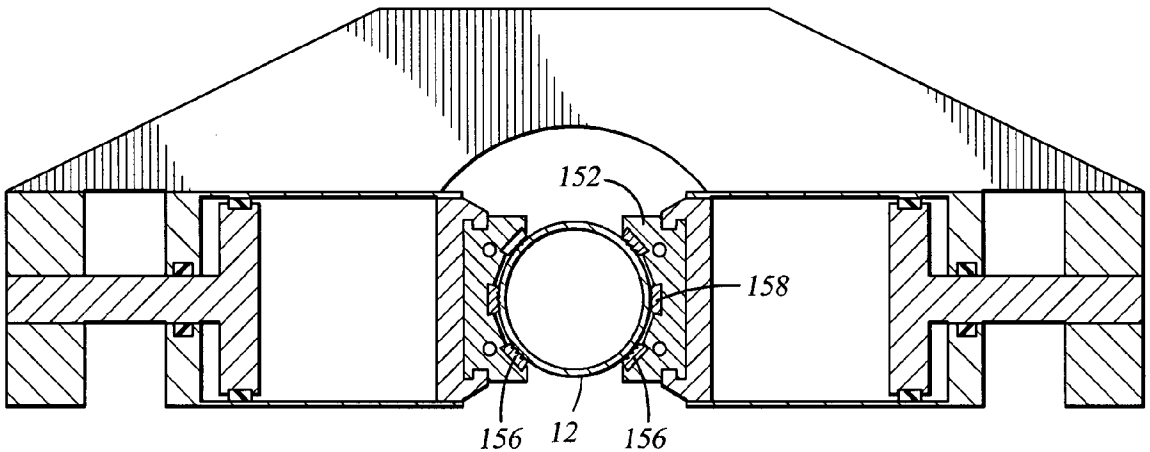
FIG. 15A is a top cross-section view of a torque wrench having a conventional jaw body including the die inserts of FIGS. 9A–C.
Figure 15B:
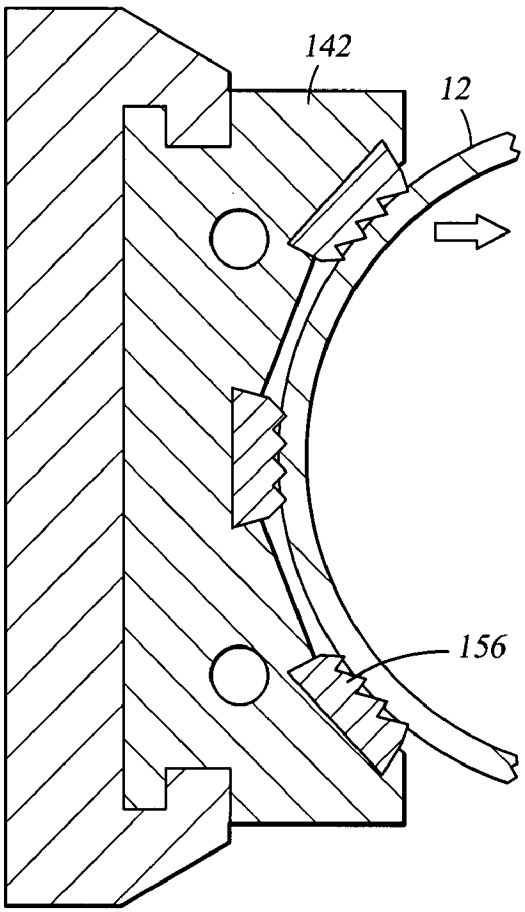
FIG. 15B is an enlarged, top cross-section view of one of the jaw bodies with die inserts of FIG. 15A.
Figure 14B:
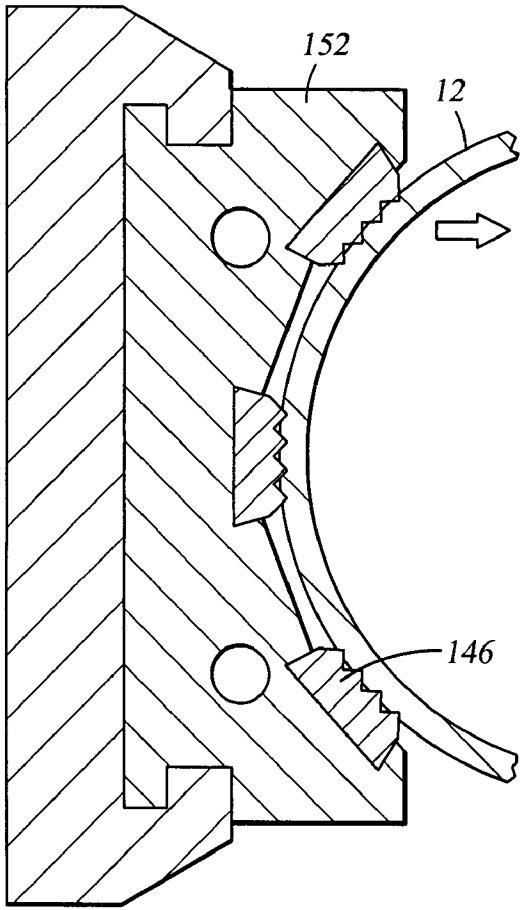
FIG. 14B is an enlarged, top cross-section view of one of the jaw bodies with die inserts of FIG. 14A.

The cam operated jaw force intensifier of the present invention makes it possible to use even conventional teeth inserts, such as insert 70 of FIG. 7A, with less slippage and damage to the pipe, although the new teeth arrangements described and shown in FIGS. 8–10 are preferred for still greater improvement. Referring to FIGS. 14A and B, conventional jaw body 142 is shown having dies inserts 146. Inserts 146 may include conventional teeth inserts, such as insert 70 of FIG. 7A, although the new teeth arrangements described and shown in FIGS. 8–10 are preferred for reducing or eliminating slippage and damage to the pipe even without the use of the cam operated jaw force intensifier of FIGS. 1–4. Similarly, FIGS. 15A and B show conventional jaw body 152 having die inserts 156, 158. FIGS. 15A and B show more particularly how die inserts 158, which may be conventional inserts 70 of FIG. 7A or the improved inserts of FIGS. 8–10, may be used in conjunction with dies inserts 156, which may be any of the improved designs of FIGS. 8–10 but are particularly shown as the design of FIGS. 9A–C.

The above discussion is meant to be illustrative of the principles and various embodiments of the present invention. While the preferred embodiment of the invention and its method of use have been shown and described, modifications thereof can be made by one skilled in the art without departing from the spirit and teachings of the invention. The embodiments described herein are exemplary only, and are not limiting. Many variations and modifications of the invention and apparatus and methods disclosed herein are possible and are within the scope of the invention. Accordingly, the scope of protection is not limited by the description set out above, but is only limited by the claims which follow, that scope including all equivalents of the subject matter of the claims.

What is claimed is:

1. An insert for use in a gripping apparatus, the insert comprising:

a base member having a longitudinal axis and a perpendicular axis;

a plurality of teeth extending from said base member, each of said teeth having a width, and wherein said teeth are formed in a first and second row, said first and second rows being substantially adjacent and parallel to said longitudinal axis;

wherein said teeth in said first row are offset longitudinally from said teeth in said second row; and wherein at least one of said teeth further includes a crest having a crest length, said crest length being less than said width of said one tooth.

2. The insert of claim 1 wherein a plurality of teeth of each of said first and second rows have the same width, and further include a crest having the same crest length, said crest length being less than said width.

3. The insert of claim 1 wherein said crest length is approximately one-half of said width.

4. The insert of claim 1 wherein said crest length is approximately within the range of 0.050 inches to 0.500 inches.

5. The insert of claim 4 wherein said crest length is approximately 0.150 inches.

6. The insert of claim 1 wherein the insert is formed of steel.

7. The insert of claim 1 wherein said teeth have a resistance profile, wherein said resistance profile is a substantially straight line.

8. The insert of claim 1 wherein the insert has a length and said teeth have an effective resistance length, said resistance length being at least 75% of said insert length.

9. The insert of claim 8 wherein said resistance length is approximately 100% of said insert length.

10. The insert of claim 1 wherein said teeth lie in more than two substantially adjacent rows.

11. The insert of claim 1 wherein said teeth are chisel-shaped.

12. The insert of claim 1 wherein said teeth are separably attached to said base member.

13. An insert for use in a gripping apparatus, the insert comprising:

a base member having a longitudinal axis and a perpendicular axis;

a plurality of teeth extending from said base member, each of said teeth having a first and second gripping face and a first and second side face, and wherein said teeth are formed in at least two substantially adjacent rows;

wherein each of said rows has gaps between said side faces of adjacent of said teeth; and wherein said gaps within one of said rows are substantially aligned parallel to said perpendicular axis with said gripping faces of said teeth in another of said rows.

14. The insert of claim 13 wherein said teeth further include a crest having a crest length, said crest length being approximately equal to the length of said gaps.

15. The insert of claim 13 wherein the insert has a length and said teeth have an effective resistance length, said resistance length being at least 75% of said insert length.

16. The insert of claim 15 wherein said resistance length is approximately 100% of said insert length.

17. An insert for use in a gripping apparatus, the insert comprising:

a base member having a longitudinal axis and a perpendicular axis;

a plurality of teeth extending from said base member, each of said teeth having a width, a first and second gripping face, and a first and second side face, wherein said teeth are formed in a first and second row, said first and second rows being substantially adjacent and parallel to said longitudinal axis;

wherein said first row is offset longitudinally from said second row; and wherein said teeth are canted.

18. An insert for use in a gripping apparatus, the insert comprising:

a base member having a longitudinal axis and a perpendicular axis;

a plurality of teeth extending from said base member, each of said teeth having a first and second gripping face and a first and second sloping side face, and wherein said teeth are formed in at least two substantially adjacent rows;

wherein each of said rows has gaps between said side faces of adjacent said teeth; and wherein said gaps are set at an angle relative to said perpendicular axis, said gaps in one of said rows being aligned with said gaps in each substantially adjacent row.

19. The insert of claim 18 wherein said gaps are formed by machining said gaps into columns at said angle from said perpendicular axis.

20. The insert of claim 18 wherein said teeth are canted.

* * * * *